US005205527A

United States Patent [19]

Anderson

[11] Patent Number: 5,205,527

[45] Date of Patent: Apr. 27, 1993

[54] RACK AND METHOD FOR MOUNTING READING MATERIAL

[75] Inventor: George L. Anderson, Delta, Canada

[73] Assignee: Bow-Wow Parts of B.C. Ltd., British Columbia, Canada

[21] Appl. No.: 837,033

[22] Filed: Feb. 14, 1992

[51] Int. Cl.[5] ..... A47B 97/00

[52] U.S. Cl. ..... 248/451; 281/47

[58] Field of Search ..... 248/451, 452, 453, 448, 248/449, 441.1; 281/47, 46, 45

[56] References Cited

U.S. PATENT DOCUMENTS

| | | | |
|---|---|---|---|
| 757,325 | 4/1904 | Lloyd | 281/47 |
| 808,181 | 12/1905 | Williams . | |
| 903,621 | 11/1908 | Tapley . | |
| 1,360,718 | 11/1920 | Bromley | 248/453 |
| 1,967,143 | 7/1934 | Caise . | |
| 1,996,191 | 4/1935 | Cook . | |
| 2,073,351 | 3/1937 | Osmau | 281/46 |
| 2,232,713 | 2/1941 | Mandel . | |
| 2,271,734 | 2/1942 | Dunham . | |
| 2,323,123 | 6/1943 | Donato et al. | 281/47 |
| 2,326,241 | 8/1943 | Martin . | |
| 2.600,808 | 6/1952 | Schroer | 281/47 |
| 2,771,075 | 11/1956 | Haskin . | |
| 3,294.245 | 12/1966 | Parce . | |
| 4,426,007 | 1/1984 | Beleckis et al. | 281/47 X |
| 4,561,623 | 12/1985 | Shepherd et al. . | |
| 4,624,480 | 11/1986 | Marthaler et al. . | |
| 4,840,407 | 6/1989 | Schroeder | 281/47 X |
| 4,878,776 | 11/1989 | Orlandini | 281/47 X |

FOREIGN PATENT DOCUMENTS

| | | | |
|---|---|---|---|
| 11510 | of 1911 | United Kingdom | 248/451 |

*Primary Examiner*—David L. Talbott
*Attorney, Agent, or Firm*—Seed and Berry

[57] ABSTRACT

A rack and method for retaining reading materials while allowing them to be read. The rack has an upwardly slanted face having support structures at the top and bottom of the rack face. The support structures have walls extending from the rack face with a plurality of apertures or slots facing each other so that rigid ribs may be placed between the pages of the reading materials and into opposing slots in the walls. The ribs are longer than the distance between an unslotted side of the bottom support structure and the slotted side of the top support structure such that the ribs are retained within the slots when gravity carries them to the bottom of the bottom support structure. The top support structure is wider than the bottom support structure so that the ribs are shorter than the distance between an unslotted side of the top support structure and the slotted side of the bottom support structure. This allows the ribs to be inserted into the top support structure far enough to be inserted in the bottom support structure slots.

20 Claims, 1 Drawing Sheet

RACK AND METHOD FOR MOUNTING READING MATERIAL

DESCRIPTION

1. Technical Field

The present invention relates a rack for releasably retaining variously sized reading materials in a position for reading them, and more particularly, to a rack that permits easy insertion and removal of the reading materials.

2. Background of the Invention

Many devices are currently in use to mount, hold, and display catalogs for people to refer to many times a day, such as a display rack for an automotive parts catalog. One current display rack for mounting these catalogs includes two parts: a mounting frame and an elevated stand. The catalog is secured to the mounting frame and the mounting frame is secured to the stand to form the complete display rack. The mounting frame has mounting rods that extend through the catalog to hold it within the mounting frame. The mounting frame attaches to the elevated stand, providing a display rack that presents the text to the reader at a comfortable angle. While this rack has worked well for many years, it has disadvantages.

Each catalog must have holes drilled through it, near their spine, for mounting. The holes must match the location of the mounting rods in the various models of frames. The spacing varies from frame to frame, depending upon the manufacturer of the catalog frame. While a combination of 3 to 5 holes of various sizes and spacing allows the catalogs to fit most mounting frames, there is no consistent assurance that the catalogs are compatible. As a result, a catalog that does not have holes drilled to an appropriate mounting pattern may not be attachable to a mounting frame at all (i.e., a telephone book). In addition, a catalog that is thicker than the available mounting frames is not attachable.

It is usual to compress many thin catalogs into one frame when an extensive library of information is needed, because only a limited quantity of frames can be attached to one display rack. The frames are usually of 1 inch in width and must be spaced according to predetermined attachment points on the display rack. This causes cramming of catalogs within each frame, making it difficult to find and separately open any one specific catalog.

Catalogs must frequently be replaced with updated versions. All catalogs within the frame must be removed to gain access to a specific one. If many catalogs are crammed together in a single frame, this requires the removal and disassembly of that frame to access the catalog being replaced.

Many catalogs are supplied in three-ring loose leaf binders so that individual sheets or sections may be updated without the need to replace the entire costly catalog. Unfortunately, current display racks do not permit mounting a combination of three-ring binders and regular catalogs.

SUMMARY OF THE INVENTION

The invention provides a rack for catalogs and other reading materials that securely retains the books while allowing them to be read. The invention provides a catalog rack that can retain catalogs without prior processing of the catalogs such as by drilling holes in the spines of the books. The inventive rack also can retain reading materials ranging from a single sheet of paper to three-ring binders to telephone directions.

The rack has a sloped face having a slotted wall at the top and bottom of the face, respectively. The book is laid spine down on the rack and one or more ribs are placed between the pages of the book. One end of the rib is held in a slot in the top wall and the other end is held in a slot in the bottom wall, receiving the catalog in the display rack. A second bottom wall, without slots, is below the slotted bottom wall to retain the ribs. The ribs are longer than distance from the top wall to the second bottom wall so that the ribs abut against the second wall and are retained within the slots. The ribs are positioned on the rack by first inserting them into a slot in the top wall and then sliding them into a slot in the bottom wall until they abut against the second bottom wall.

DETAILED DESCRIPTION OF THE INVENTION

Figure 1:
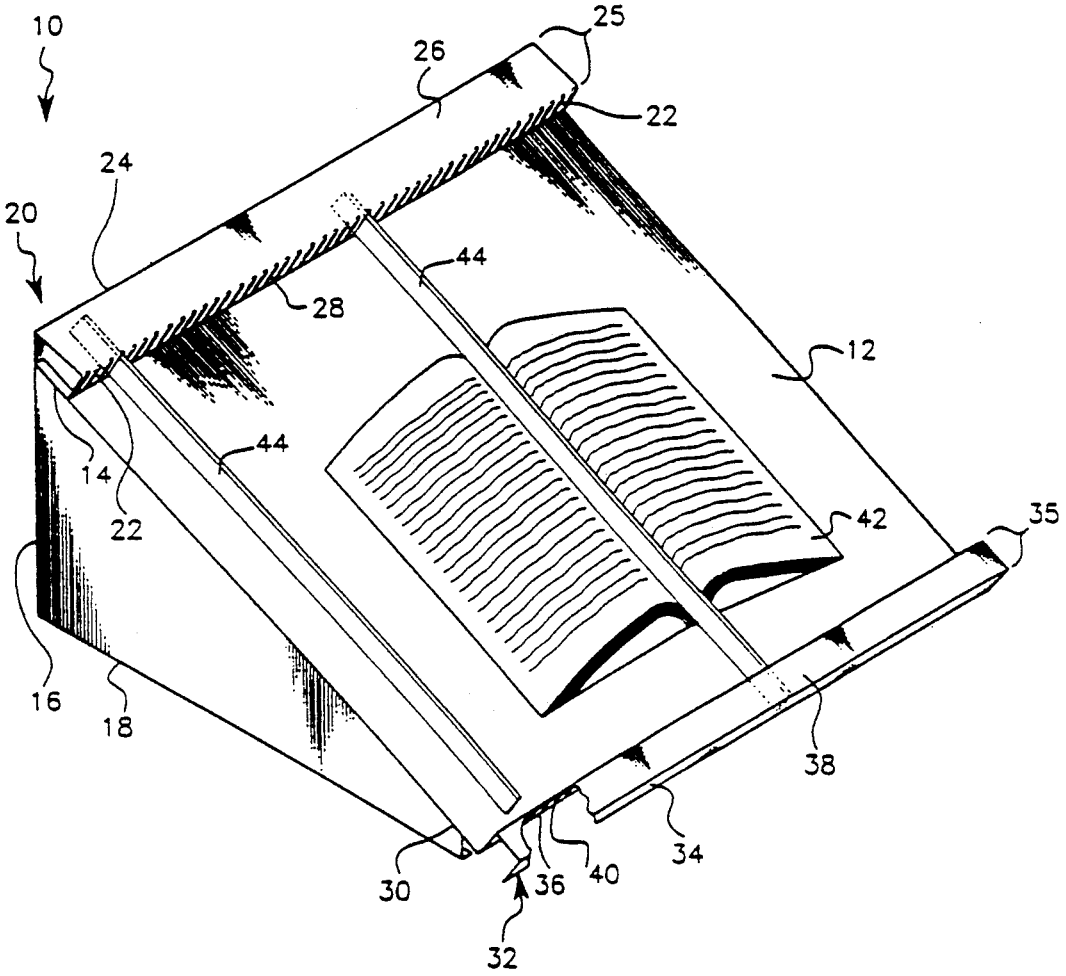
FIG. 1 is an isometric view of the inventive rack retaining a book.

As shown in FIG. 1, the rack 10 includes a sloped rack face 12 having its top end 14 raised vertically above its bottom end 30. A pair of sidewalls 18 and a rear wall 16 support the rack face 12 in the desired position. Extending along the top end 14 of the rack face 12 is a top support structure 20 having a front wall 22, a back wall 24, and a top wall 26. The front wall 22 of the top support structure 20 includes a plurality of apertures 28 in the shape of slots extending from the rack face 12 to the top wall 26. The back wall 24 is spaced a selected distance 25 behind the front wall 22, as described herein in more detail.

Extending along the bottom end 30 of the rack face 12 is a bottom support structure 32. The bottom support structure 32 includes a front wall 34, a back wall 36, and a top wall 38. The front wall 34 is spaced a selected distance 35 from the back wall 36, this distance 35 being less than the selected distance 25 between the two walls of the top support structure, walls 22 and 24. The back wall 36 of the bottom support structure 32 includes a plurality of apertures 40 in the shape of slots extending from the rack face 12 to the top wall 38. The number of bottom slots 40 equals the number of top slots 28 with each slot 40 aligned with a corresponding slot 28.

A book 42 is mounted by placing its spine on the rack face 12 and opening it to a selected page. The top end of a rib 44 is then inserted into a slot 28 in the front wall 22 and is placed in-between pages of the open book 42. The top end of the rib 44 is inserted into the slot sufficiently far that the bottom end clears the wall 36 of the bottom support structure. The length of the rib 44 is shorter than the distance from the back wall 24 of the top support structure 20 to the back wall 36 of the bottom support structure 32. This allows the top end to be inserted sufficiently far into the slot 28 that the bottom end of the rib 44 passes the wall 36 and can slide into the corresponding slot 40 in the bottom support structure 32 opposite the top support structure slot 28 containing the first end of the rib 44, as shown by the rod 44 in FIG. 1 that is not in book 42. The rod 44 is then inserted into slot 40 and slid into contact with front wall 34 of bottom support structure 32. Since the rack face 12 is slanted upwardly, gravity holds the rib 44 in the bottom support structure 32 with the rib 44 abutting the interior of the bottom support structure front wall 34. The top end of the rib 44 remains in the top slot 28 when the bottom end is in contact with the wall 34 because the rib 44 is longer than the distance from the bottom support structure front wall 34 to the top support structure front wall 22. The rib will contact the bottom support structure front wall 34 before it falls out of the top slot 28 because the selected distance 35 between the two bottom walls is less than the selected distance 25 between the two top walls. The rib 44 is retained within the support structures 20, 32 and on the rack face 12 to securely retain a book 42 on the rack face 12.

To remove the book 42 from the rack 10, the rib 44 is slid far enough into the top support structure 20 to allow the bottom end of the rib to escape from the bottom support structure 32. The distance between the two top support walls 22 and 24 is greater than the distance between the two bottom walls 34 and 36 to ensure that the bottom end of rib 44 comes out of slot 40 prior to the top end abutting against the back top wall 24. Once the bottom end of rib 44 is out of the bottom support structure 32, it can be removed from the top support structure 20 and from the top of the book 42.

It should be appreciated that slots 28 and 40 may extend into the top walls of the respective support structures. As long as the length of each rib 44 is less than the distance from the back wall 24 of the top support structure 20 to the furthest point of extension of slot 40 into the top wall 38 of bottom support structure 32, the rib will be insertable and removable from the rack 10. Likewise, each rib 44 should be longer than the distance from the front wall 34 of the bottom support structure 32 to the furthest point of extension of slot 28 into the top wall 26 of top support structure 20 such that the rib 44 is retained within the slots in the absence of sliding the rib 44 further into the top support structure 20.

Preferably the rib 44 is made of a rigid material, such as steel, and is sufficiently stiff to be substantially inflexible in the vertical direction when a book is being held in the rack face 12. The rib 44 must be sufficiently inflexible such that it cannot be flexed out of the support structures using the forces normally associated with attempting to pull a book from a rack. The rack 10 is designed such that the rib 44 can easily be removed by sliding it into the top support structure 20 far enough to lift the rib 44 out of the bottom support structure 32 without bending it.

In one embodiment, the rib 44 is a flat slat, as shown, that is easily inserted into the slots and is sufficiently wide that it is stiff in the vertical direction (it may be somewhat flexible in the thinner, horizontal direction). Alternatively, the ribs 44 may be round, oval, square, or other shape as long as the vertical inflexibility is retained and the ribs are of proper length.

Although FIG. 1 shows the rack 10 retaining a single book 42, rack 10 is designed to retain a large number of reading materials of various sizes simultaneously. For large reading materials, such as telephone directories or automobile parts catalogs, a plurality of ribs 44 may be placed in the book, each at selected intervals between the pages to provide a more secure retention. For retaining items such as three-ring binders, a rib 44 may be placed along the back of the binder or on each side of the binder rings to retain the binder rings in the rack 10. The reading material is then held by the binder rings. This allows the information in the binder to be continually updated by opening the binder without needing to remove the binder from the rack or modify the binder in any way.

To accommodate variously sized reading materials, the vertical dimensions of the slots 28, 40 are larger than the vertical dimension of the ribs 44. This allows the ribs 44 to move vertically upward in the slots 28, 40 to allow a thick reading material to fit under the ribs. For smaller reading materials such as magazines, or even a single folded sheet of paper, the ribs 44 move vertically downward until almost flush with the rack face 12 to rest firmly on the reading material to retain it to the rack face 12. For larger reading materials, such as a telephone directories or automobile parts catalogs, the ribs 44 move vertically upward to allow the thicker spines of the larger materials to fit under the ribs 44 and thereby to be retained by the ribs 44 to the rack face 12.

If desired, the support structures 20, 32 may be modified without departing from the invention. For example, the back wall 24 of the top support structure 20 is not present in an alternative embodiment. That allows the ribs 44 to extend well beyond the top of the rack when mounting or removing books. The ribs 44 could then be inserted from the back side of the top support structure 20 and inserted through the top and bottom slots 28, 40 with a single downward motion. Since the rack face 12 is slanted upwardly, the ribs 44 are retained on the interior of the bottom support structure 32.

In a further alternative embodiment, the top walls 26, 38 are modified or are not present. One purpose of the top walls 26, 38 is to prevent the ribs 44 from being forced out of the slots 28, 40 by upward force due to the size of the reading materials. This purpose may be accomplished by simply by not extending the slots 28, 40 to the top of the sidewalls 22, 36. The upper parts of sidewalls 22, 36 would suffice to capture the ribs 44 within the slots 28, 40. This embodiment allows some savings of material costs by removing top walls 26, 28, but may reduce the visual appeal and stability of sidewalls 22, 24, 34, and 36.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A rack for releasably retaining reading materials, comprising:

a rigid rack face having a bottom end and a top end, the top end being raised vertically with respect to the bottom end;

a first top wall extending from the rack face along the top end, the first top wall having a plurality of apertures extending therethrough, each of the apertures having a permanently closed upper side;

a support structure extending along the bottom end of the rack face, the support structure having a first bottom wall extending upwardly from the rack face, the first bottom wall having a plurality of apertures extending therethrough, each of the apertures having a permanently closed upper side, a second bottom wall positioned such that the first bottom wall is spaced a selected distance from the second bottom wall and the first bottom wall is between the second bottom wall and the first top wall; and an elongated rib having a first end portion positioned within a first top wall aperture, a second end portion positioned in a first bottom wall aperture, the second bottom wall preventing the rib from extending more than the selected distance through the first bottom aperture beyond the first bottom wall, the rib being longer than the distance between the first top wall and the second bottom wall such that the rib is retained within the apertures of the first top wall and the first bottom wall so that the rib retains the reading material to the rack face.

2. The rack of claim 1 wherein the rib is substantially straight along its entire length.

3. The rack of claim 1 wherein the rib does not bend in the vertical direction.

4. The rack of claim 1, further including:

a second top wall extending upwardly from the rack face and positioned such that the first top wall is between the first bottom wall and the second top wall, the distance between the second top wall and the first bottom wall is greater than the length of the rib to allow the first end of the rib to be inserted far enough into the first top aperture to allow the second end of the rib to be inserted into the first bottom aperture.

5. The rack of claim 1 wherein the dimensions of the apertures in the vertical direction are greater than the vertical dimension of the rib such that the rib can move vertically within the apertures to accommodate variously sized reading materials.

6. The rack of claim 1 wherein the first top wall has at least one second top aperture and the first bottom wall has at least one second bottom aperture immediately adjacent the first top and bottom apertures, respectively, such that at least one second elongated rib may be retained in the second top aperture and the second bottom aperture adjacent the first rib and within the same reading material so that a single reading material is retained simultaneously by two ribs.

7. The rack of claim 1 wherein the first top wall has at least one second top aperture and the first bottom wall has at least one second bottom aperture such that at least one second elongated rib may be retained in the second top aperture and the second bottom aperture so that the second elongated rib retains a second reading material to the rack face.

8. The rack of claim 1, wherein the upper side of each aperture is a third top wall extending from the first top wall away from the bottom end of the rack face, the first top wall aperture extending into the third top wall, the rib being longer than the distance from the second bottom wall to the point of farthest extension of the first top wall aperture into the third top wall such that the rib is retained within the first top wall aperture by the third top wall.

9. A rack for releasably retaining reading materials, comprising:

a rigid rack face having a bottom end and a top end, the top end being raised vertically with respect to the bottom end;

a first support structure extending along the top end of the rack face and extending upwardly from the rack face having a first top wall with a first top aperture, a second top wall, at least one of the first top wall and the second top wall extending upwardly from the rack face, the second top wall being spaced a selected distance from the first top wall, and a third top wall extending between the first and second top walls and forming an upper side of the first support structure;

a second support structure extending along the bottom end of the rack face and extending upwardly from the rack face having a first bottom wall with a first bottom aperture, a second bottom wall, at least one of the first bottom wall and the second bottom wall extending upwardly from the rack face, the second bottom wall being spaced a selected distance from the first bottom wall, the selected distance between the bottom walls being less than the selected distance between the top walls, and a third bottom wall extending between the first and second bottom walls and forming an upper side of the second support structure, the second bottom wall positioned such that the first bottom wall is between the second bottom vertical wall and the first top vertical wall; and a first elongated rib having a first end positioned in the first top aperture and a second end positioned in the first bottom aperture, the second end being prevented from extending farther into the first bottom aperture than the selected distance between bottom walls by the second bottom wall, the rib being longer than the distance between the first top wall and the second bottom wall such that the rib is retained within the apertures to retain a reading material to the rack face.

10. The rack of claim 9 wherein the rib is substantially straight along its entire length.

11. The rack of claim 9 wherein the rib does not bend in the vertical direction.

12. The rack of claim 9 wherein the vertical dimensions of the apertures are greater than the vertical dimension of the rib such that the rib can move vertically within the apertures to accommodate variously sized reading materials.

13. The rack of claim 9 wherein the first top vertical wall has a second top aperture and the first bottom wall has a second bottom aperture such that a second elongated rib may be retained in the second top aperture and the second bottom aperture.

14. The rack of claim 9 wherein the first top wall aperture extends into the third top wall, the rib being longer than the distance from the second bottom wall to the point of farthest extension of the first top wall aperture into the third top wall such that the rib is retained in the first top aperture by the third top wall.

15. A method of releasably retaining reading materials to a rack having a face with its top end higher than its bottom end, comprising:

placing the reading material on the rack face with the spine of the reading material against the rack face and supported thereby, with the reading material open;

placing an elongated rib on top of the reading materials when opened;

inserting a first end of the rib into a slot in a top wall extending upwardly from the rack face, the slot having a permanently closed upper side; and inserting a second end of the rib into a slot formed in a first bottom wall extending upwardly from the rack face, the slot having a permanently closed upper side, the second end of the rib being stopped from being inserted further into the first bottom wall slots by a second bottom wall extending upwardly from rack face.

16. The method of releasably retaining reading materials to the rack according to claim 15, further comprising:

sliding the first end of the rib into the top wall slot far enough to allow the second end of the rib to be lifted from the bottom wall slot without bending the rib;

removing the second end of the rib from the bottom wall slot; and removing the first end of the rib from the top wall slot.

17. A rack for releasably retaining reading materials, comprising:

a rigid rack face having a bottom end and a top end, the top end being raised vertically with respect to the bottom end;

a first top wall extending from the rack face along the top end, the first top wall having a plurality of apertures extending therethrough, each of the apertures having a permanently closed upper side;

a support structure extending along the bottom end of the rack face, the support structure having a first bottom wall extending upwardly from the rack face, the first bottom wall having a plurality of apertures extending therethrough, each of the apertures having a permanently closed upper side, a second bottom wall positioned such that the first bottom wall is spaced a selected distance from the second bottom wall and the first bottom wall is between the second bottom wall and the first top wall;

an elongated rib having a first end portion positioned within a first top wall aperture, a second end portion positioned in a first bottom wall aperture, the second bottom wall preventing the rib from extending more than the selected distance through the first bottom aperture beyond the first bottom wall, the rib being longer than the distance between the first top wall and the second bottom wall such that the rib is retained within the apertures of the first top wall and the first bottom wall, so that the rib retains the reading material to the rack face; and wherein the elongated rib has a vertical dimension that is sufficiently less than the vertical dimensions of the apertures so as to allow the rib to move upwardly in the aperture to retain a relatively thick reading material between the rib and the rack face and also allow the rib to move downwardly in the aperture to retain a relatively thin reading material between the rib and the rack face.

18. The rack of claim 17, further including:

a second top wall extending upwardly from the rack face and positioned such that the first top wall is between the first bottom wall and the second top wall, the distance between the second top wall and the first bottom wall is greater than the length of the rib to allow the first end of the rib to be inserted far enough into the first top aperture to allow the second end of the rib to be inserted into the first bottom aperture.

19. The rack of claim 17 wherein the first top wall has at least one second top aperture and the first bottom wall has at least one second bottom aperture such that a second elongated rib may be retained in the second top aperture and the second bottom aperture so that the second elongated rib retains a reading material to the rack face.

20. The rack of claim 17, further including a third top wall extending from the first top wall away from the bottom end of the rack face, the first top wall aperture extending into the third top wall, the rib being longer than the distance from the second bottom wall to the point of farthest extension of the first top wall aperture into the third top wall such that the rib is retain within the first top wall aperture by the third top wall.

* * * * *